US007505721B2

(12) United States Patent
Smeijers

(10) Patent No.: US 7,505,721 B2
(45) Date of Patent: Mar. 17, 2009

(54) IMAGE REGISTRATION DEVICE

(75) Inventor: Johannes H. L. Smeijers, Venlo (NL)

(73) Assignee: Oce-Technologies B.V., Venlo (NL)

( * ) Notice: Subject to any disclaimer, the term of this patent is extended or adjusted under 35 U.S.C. 154(b) by 175 days.

(21) Appl. No.: 11/228,386

(22) Filed: Sep. 19, 2005

(65) Prior Publication Data

US 2006/0062488 A1 Mar. 23, 2006

(30) Foreign Application Priority Data

Sep. 20, 2004 (EP) ..... 04104533

(51) Int. Cl.
*G03G 15/01* (2006.01)

(52) U.S. Cl. ..... 399/301

(58) Field of Classification Search ..... 399/301
See application file for complete search history.

(56) References Cited

U.S. PATENT DOCUMENTS 4,135,664 A 1/1979 Resh
5,828,926 A * 10/1998 Iwata et al. ..... 399/66
2002/0141780 A1* 10/2002 Kanemoto ..... 399/117

FOREIGN PATENT DOCUMENTS

DE 31 38 755 A1 5/1982
JP 8-63043 A 3/1996
JP 2002-287570 A 10/2002

* cited by examiner

*Primary Examiner*—David M Gray
*Assistant Examiner*—Laura K Roth
(74) *Attorney, Agent, or Firm*—Birch, Stewart, Kolasch & Birch, LLP

(57) ABSTRACT

An image registration device for an image production system is disclosed which adjusts any axial image misregistration in situ and quasi instantaneously. This image registration device contains, in operation, a rotating image carrying element and a rotating image receiving element in rolling contact with each other and each having a flange co-axially mounted on their respective shafts. The image registration device includes a further rotating element in rolling contact with the flanges of the rotating elements to ensure that the image carrying element axially follows the image receiving element or vice versa to establish axial image registration.

10 Claims, 3 Drawing Sheets

IMAGE REGISTRATION DEVICE

FIELD OF THE INVENTION

The present invention is directed to an image registration device for an image production system for transferring separation images of a marking substance, including ink and toner, in register from a rotatable image-carrying member to a rotatable image-receiving member.

BACKGROUND OF THE INVENTION

Image production systems, such as printers and copiers, often include a rotatable image-receiving member, usually in the form of a belt or a drum, for receiving on its surface a marking substance, such as toner or ink, in image form, from a rotatable image carrying member, usually also in the form of a drum or a belt. The image-receiving member may either receive the image directly on its surface or on a recording medium conveyed on its surface. The images of marking substance are transferred from the image-carrying member to the image-receiving member in a transfer zone where the image-receiving member and the image-carrying member are in rolling contact. The transfer may take place by means of pressure, or heat, or electrostatic forces, or magnetic forces, or vibrational forces, or a combination of some of the aforementioned forces and effects. The image may be a monochrome image or a composite image. In the latter case, to enable multi-color printing, a plurality of process colors and a plurality of image-carrying members may be provided, each image-carrying member for carrying a separation image of the respective process color. In operation, each of the plurality of image carrying members is engaged in rolling contact with the image-receiving member along its path of rotation thereby defining transfer zones where the separation images of the respective process colors are sequentially transferred in registration to the image-receiving member thereby forming a composite image of marking substance. The slightest misregistration may lead to visual print quality degradation. To form an accurate and clear composite image on the image-receiving member, the rotational and lateral position of the respective image carrying members as well as the image-receiving member must be mutually precisely aligned and this alignment must be maintained in use. Rotational position errors lead to registering errors in the process direction, i.e., the propagation direction of the medium. This phenomenon is also referred to as tangential image misregistration. Tangential image misregistration is usually controlled by adequately controlling the timing of the formation of the respective separation images and any subsequent image transfers. Lateral position errors lead to registering errors along the axis of rotation of the respective image-carrying and/or image-receiving members, i.e., the direction perpendicular to the process direction. This phenomenon is also referred to as axial image misregistration. For instance, lateral position errors may be caused by wobbling of a rotating image-carrying and/or image-receiving member, thermal effects resulting in variations of the dimensions or the position of the image-carrying and/or image-receiving member. To prevent or at least limit axial image misregistration, one may opt to form register marks in the respective process colors on the respective image carrying member and subsequently transfer them to the image-receiving member. By determining the axial positions of the respective register marks on the image receiving member or on the recording medium, an indication may be obtained for the potential axial disposition of an image-carrying element with respect to the image-receiving element or with respect to any other image-carrying element. This determination may be done by means of an image sensing device and may be done periodically or continuously, i.e., without interrupting the printing process. Control means and displacement means may be provided to make adjustments responsive to such indication to the lateral position of one or more image-carrying elements and/or the image receiving element. Examples of displacement means include a lateral positioning motor, as disclosed in U.S. Pat. No. 4,135,664, or an actuator. Although the described approach for limiting axial image misregistration may work fine in most operating conditions, it does not deal effectively with sudden changes in the lateral position of one or more of the cycling members, such as e.g., changes caused by leaning on or accidentally pushing against the printing system. In the latter case, printing must be stopped and the system must be re-calibrated before continuing the printing process.

SUMMARY OF THE INVENTION

Thus it is an object of the present invention to provide an image registration device which allows for improved axial image registration in all circumstances.

It is a further object of the present invention to provide an image registration device which adjusts for any axial image misregistration, in situ and quasi instantaneously, without affecting the productivity of the image production system.

To meet these objects, according to the present invention, there is provided an image registration device for an image production system which includes:

a first rotatable element for carrying images of marking substance on its surface, the first rotatable element being provided with a first shaft and a first flange co-axially mounted on the first shaft adjacent the first rotatable element; and a second rotatable element for receiving on its surface images from the first rotatable element, the second rotatable element being mounted axially parallel with the first rotatable element such that in operation the second rotatable element is in rolling contact with the first rotatable element, the second rotatable element being provided with a second shaft and a second flange co-axially mounted on the second shaft adjacent the second rotatable element at the corresponding side compared to the mounting of the first flange, wherein the image registration device further includes:

a third rotatable element and pressure exerting means for pressing in operation the third rotatable element with a predetermined pressure in rolling contact with the first flange and the second flange such that one of the first and second rotatable element axially follows the other one. The image carrying element may be the image forming element or one of the image forming elements, while the image receiving element is a conveyor roller which is engaged in contact with the image forming element thereby defining a transfer zone through which the recording medium is conveyed either in web or in sheet form. Separate means may be provided to controllably align the recording medium with respect to the conveyor roller. Instead of a conveyor roller also a conveyor belt may be used. In the latter case the image receiving element may be the backing roller which is engaged in contact with the image forming element thereby defining a transfer zone through which both the recording medium and the conveyor belt are conveyed. Separate means may be provided to controllably align the recording medium with respect to the conveying belt and the conveying belt with respect to the backing roller.

The present invention is particularly relevant to printers and copiers where, to enable printing on a wide variety of recording media, an intermediate image transfer member is provided to transfer an image of marking substance originating from one or more image forming members via the intermediate image transfer member(s) to the recording medium. In such systems, the rotatable image carrying member may be one of the image forming members, while the rotatable image receiving member may be the intermediate image transfer member. Alternately, the image carrying element may be the intermediate image transfer member, while the image receiving element is a conveyor roller which is engaged in contact with the intermediate image transfer member thereby defining a transfer zone through which the recording medium is conveyed either in web or in sheet form.

The feature that, in operation, the rotating image carrying element is enforced to axially follow the rotating image receiving element or vice versa by a mechanical construction using flanges on the respective rotating elements and a further rotating element in rolling contact with the flanges is advantageous as it allows to adjust for any axial mispositioning, quasi instantaneously and continuously. As this takes place in the operative state, i.e., the recording medium is fed in sheet or in web form through the transfer zone and hence prints or copies of images are generated, this registration process does not negatively affect the productivity of the printer or copier. When pressing the further rotating element towards the flanges with a predetermined pressure, the configuration is such that either the image carrying element or the image receiving element remains in position. In other words, the rotatable element which maintains its axial position despite the predetermined pressure exerted by the pressure exerting means, is axially confined. For instance, in order to axially confine one of the rotatable elements, one may opt to rigidly connect that rotatable element to the base support frame of the image production system.

Preferably the axially confined element is the image receiving element. In the latter case, the image carrying element is mounted such that it can move in the axial direction when pressing the further rotatable element against its flange with the predetermined pressure. In particular the image carrying element is forced towards the further rotatable element with a fixed force being balanced against the force exerted on the flange of the image carrying element by the further rotatable element which is pressed towards the flanges with a predetermined fixed pressure. As a consequence, the image carrying element will axially follow the axially confined image receiving element.

In an embodiment according to the present invention, the pressure exerting means for pressing the third rotatable element towards the flanges is an elastic pressure exerting means. In particular, the elastic pressure exerting means may comprise a first spring for pressing the third rotatable element towards the first and second flange and a second spring for pressing the non-confined one of the first and second rotatable elements towards the third rotatable element.

In the case of a printer or copier having an intermediate image transfer member, the axially confined element is preferably the intermediate image transfer member. The image carrying element and the image receiving element may be selectively movable into and out of contact with each other and may be independently driven. Alternately, these items can be driven by the movement of the image receiving element. The third rotatable element usually is a cylindrical element such as e.g., a roller.

The kind of marking substance and image forming member which is used depends on the imaging technique used. Examples of imaging techniques include ink jet, electrography including electrophotography, and magnetography. Examples of marking substance include ink, dry particulate toner, and liquid toner. For instance in case of electrophotography, the marking substance may be a dry particulate toner, while the image forming member is a drum or a belt with a photoconductive outer layer whereon a latent image is formed and subsequently developed with toner.

In another embodiment according to the present invention, the angle between the rotation axis of the third rotatable element and the first shaft can be chosen and set in the range from 85 degrees to 95 degrees. To accomplish this, control means may be provided for controlling the angle between the rotation axis of the third rotatable element and the first shaft.

In yet another embodiment according to the present invention, the image receiving element of the image registration device is axially confined. Instead of a single image carrying element, a plurality of rotatable image carrying elements is provided for carrying images of marking substance on its surface, each of the plurality of image carrying elements being provided with a first shaft and a first flange co-axially mounted on the first shaft adjacent the respective image carrying element. The image registration device further comprises a plurality of third rotatable elements and a plurality of pressure exerting means, each of the plurality of pressure exerting means being provided for pressing into operation each of the plurality of third rotatable elements with a predetermined pressure in rolling contact with the flange of the respective image carrying element and the flange of the image receiving element such that each of the image carrying elements follows the axially confined image receiving element. Preferably, each of the angles between the rotation axis of each of the third rotatable elements and the shaft of the corresponding image carrying element is substantially the same.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

The present invention is described in detail and in sequel in the appended drawings. Several embodiments are disclosed. It is apparent however that a person skilled in the art can imagine other equivalent embodiments or other ways of executing the present invention.

Figure 1:
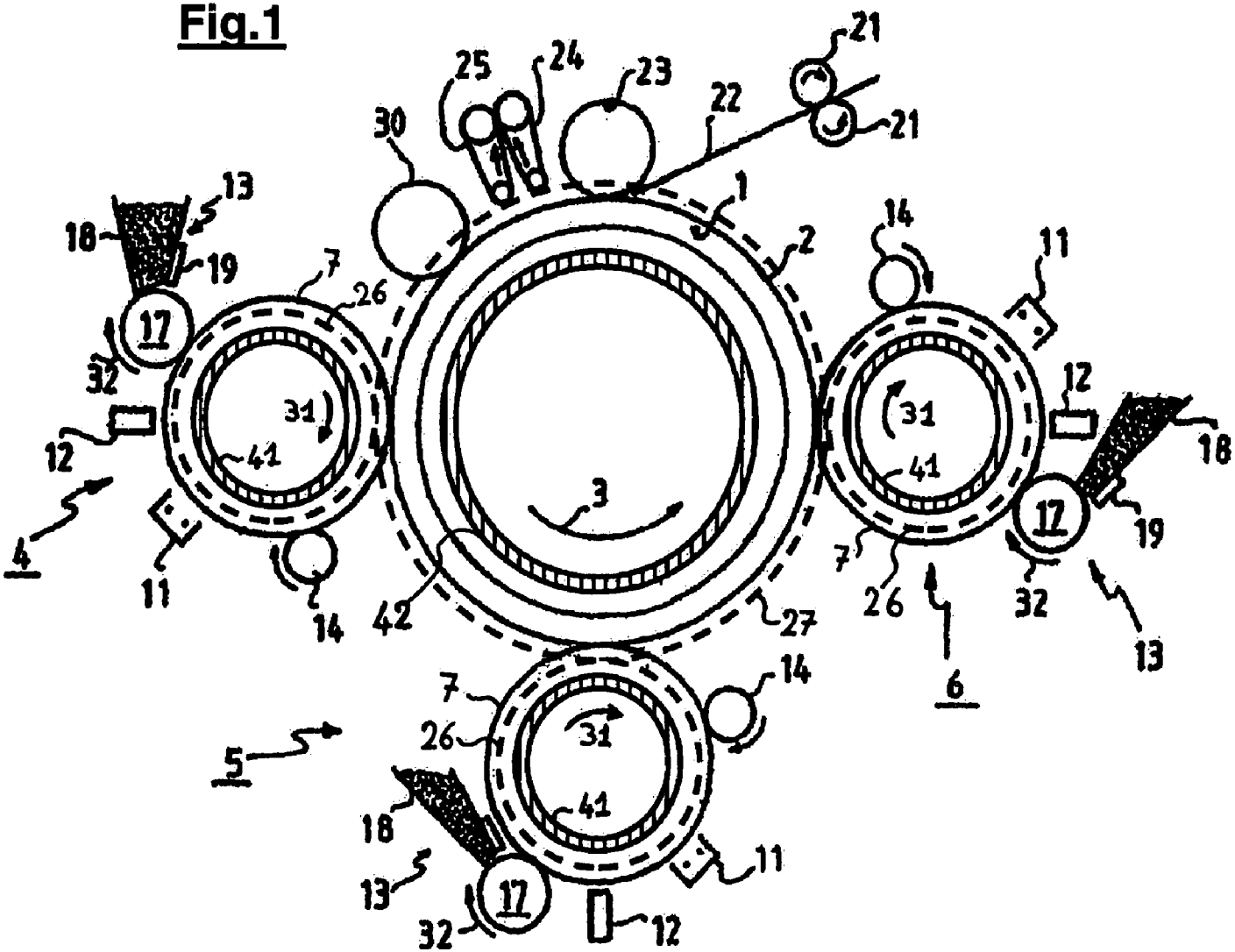
FIG. 1 is a schematic illustration of a printer according to an embodiment of the present invention.

A printing system capable of printing on sheets of a recording medium is depicted in FIG. 1. The printing system comprises an image transfer member 1, which can be moved cyclically. The image transfer member 1 is an endless member, such as e.g., a drum or a belt. In this case the image transfer member is a cylindrical drum, which can be moved in the direction of the arrow 3. The image transfer member 1 is constructed of a metal sleeve, e.g., aluminum, with an elastomeric covering 2. Optionally, the image transfer member may be provided with an outer layer of silicone rubber, or a PTFE, or a fluororubber, e.g., by means of a coating. One or more process colors are available on the printing system, dependent on whether it concerns a monochrome or a multicolor printing system. For each process color, an image forming unit 4 5 6 is disposed along the path of rotation of the intermediate transfer member. Each of these image forming units comprises a cylindrical image forming member 7 on which a color separation image of the corresponding process color is formed. The image forming members 7 are rotatable in the direction of the respective arrows 31. In an operative state, the image forming members are all in pressure contact with the image transfer member, the force with which the image forming members 7 are pressed against the image transfer member being, at a maximum, 1100 N per linear meter, e.g., 250 N per linear meter. Each image forming member is formed of a metal drum with a photo-conductive outer layer thereon, the various image forming devices being positioned along the circumference of the image transfer member. These image forming devices comprise a charging device 11, e.g., a corona device, an exposing device 12, e.g., a LED array, for image-wise exposure of the photo-conductive surface to thereby form a latent charge image thereon, a development device 13 for developing the latent image with a marking substance, and a cleaning device 14 for removing any residual marking substance present on the image forming member after transfer of the developed separation image to the image transfer member. The development device is, in this case, a magnetic brush development device which is a magnetic roller 17 containing of a rotatable sleeve with a stationary magnet system therein. The magnetic roller is positioned along the circumference of the image forming member with its surface at a short distance from the image forming member surface without contacting it. The magnetic rollers 17 are rotatable in the direction of the respective arrows 32. A reservoir 18 with electrically conductive magnetically attractable dry particulate toner is positioned near the surface of each of the magnetic rollers 17. Each reservoir contains toner in one of the process colors. A stripper 19 is provided at each reservoir to ensure that an even layer of particulate toner is applied to the sleeve of the magnetic roller.

Also disposed along the path of rotation of the image transfer member 1 is a rotatable counter roller 23 and a rotatable cleaning roller 30. The counter roller is selectively movable towards and away from the image transfer member surface with a controlled pressure. Means (not shown) are provided to drive the counter member. When pressing the counter member against the image transfer member surface a transfer zone is defined through which, in operation, sheets of recording medium are passed using feed means and sheet discharging means. The feed means includes co-operating conveyor rollers 21 and a guide plate 22. The sheet discharging means includes co-operating conveyor belts 24 25. The rotatable cleaning roller has a tacky surface. The cleaning roller 30 may be driven by drive means (not shown) and is selectively movable into and out-of an operative position in which the cleaning member surface is in contact with the image transfer member surface.

Figure 2:
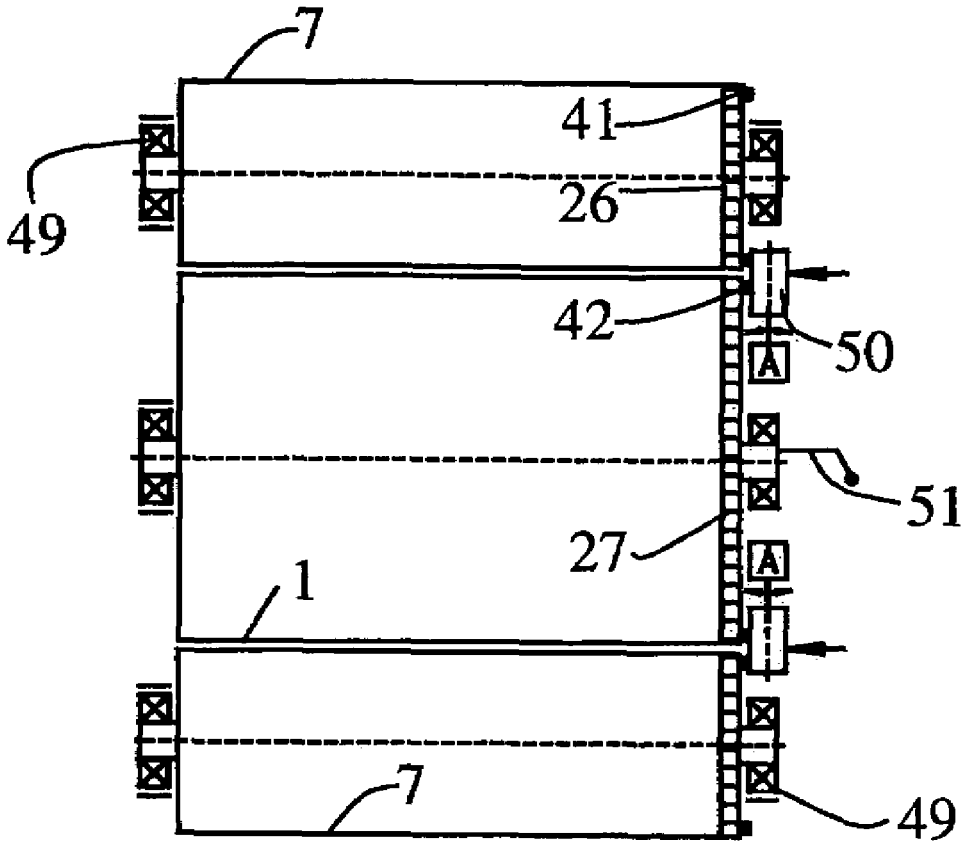
FIG. 2 is a schematic illustration of an image registration device according to an embodiment of the present invention.

In one embodiment, also referring to FIG. 2, the printer comprises an image registration device having a plurality of image carrying elements, being the rotatable image forming drums 7, and a rotatable image receiving element, being the image transfer drum 1. Each of the image forming drums has a shaft and is driven by a first gearwheel 26 co-axially mounted thereon. Each first gearwheel 26 engages a second gearwheel 27, which is co-axially mounted on the driven shaft of the image receiving drum. First gearwheel 26 and second gearwheel 27 are also indicated in FIG. 1 in the form of interrupted circles which also indicate the pitch circle of each gearwheel. The transmission ratio between the second gearwheel and the first gearwheel is selected to be about the same or slightly greater than the transmission ratio that would occur if the image carrying drum and the image receiving drum would be driven only by friction as a result of pressure contact therebetween. A first flange 41 is mounted between the first gearwheel 26 and the bearings 49 of each of the image forming drums, while a second flange 42 is mounted between the second gearwheel 27 and the bearings 49 of the image receiving drum. The image registration device also comprises for each image forming drum an associated further rotatable element 50. In operation, pressure contact is provided between each of these further rotating elements and both the first flange of the corresponding image forming drum 7 and the second flange of the image receiving drum. Means may be provided to set the angle between the rotation axis of each of the further rotatable elements 50 and the associated first shaft. This angle can be selected and set in the range of from 85 degrees to 95 degrees. Preferably, each of the angles between the rotation axis of each of the further rotatable elements and the first shaft of the corresponding image carrying drum is substantially the same. The further rotatable elements are rollers, further referred to as follower rollers. A follower roller may have a diameter in the range from 1 cm to 5 cm, more preferably from 1 cm to 2 cm, and a length in the range from 1 cm to 15 cm, more preferably from 1 cm to 5 cm. It is advantageous to limit the mutual distance between the first and second flange and by consequence the length of the follower roller to minimize the influence of wobbling of the follower roller on the axial image registration. Preferably all follower rollers have substantially the same dimensions and all image carrying drums have substantially the same dimensions. The first and second flanges are made of stainless steel and are ring-shaped. Other stiff materials which are sufficiently resistant against wear may, however, also be used. The flanges typically have a limited thickness of e.g., about 2 mm. The thickness is the dimension in the axial direction. The over diameter of the ring-shaped flanges is preferably smaller than the outer diameter of the corresponding drum. More preferably the ratio between the outer diameter of the second flange and the diameter of the first flange is about the same as the transmission ratio between the second and first gearwheel. Doing so assures a slipless, rolling contact between the follower roller and the corresponding flanges. Optionally for each flange a scraping blade may be provided for contacting the contact surface thereof to remove any contaminants, including marking substance, present thereon. Preferably, these scraping blades are made of a polyimide.

Figure 3:
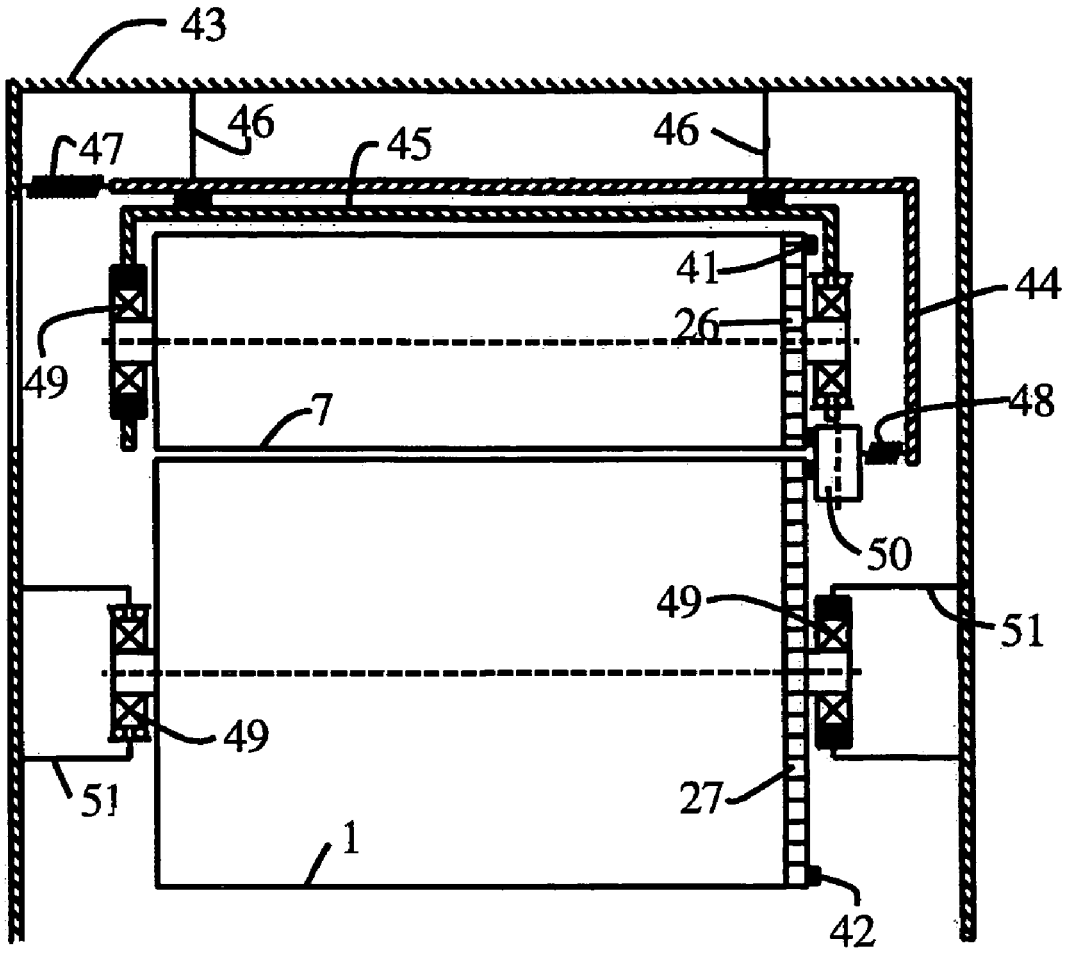
FIG. 3 is a schematic illustration of the mounting of an image registration device to a printer according to an embodiment of the present invention.

By axially confining the image receiving drum and maintaining pressure contact between each of the follower rollers and both the associated first flange and the second flange, each of the image carrying drums is forced to axially follow the image receiving drum. There are several implementations possible. Am exemplary implementation is depicted in FIG. 3. In particular, FIG. 3 schematically demonstrates how an image registration device is mounted to the printer and in which pressure exerting means 47 48 is provided to establish and maintain rolling contact in operation between a follower roller and the flanges 41 42 on the image carrying drum 7 and the image receiving drum, respectively. Rigid connections 51 are provided connecting the image receiving drum to the base support frame 43 of the printer. The image carrying drum is mounted to the drum support frame 45 which is rigidly connected to an intermediate support frame 44. This intermediate support frame is suspended on the base support frame 43 by means of two leave springs 46 such that it is able to move in the axial direction but is confined in the tangential direction. A pre-tensioned pulling spring 47 is provided between the intermediate support frame and the base support frame, which exerts a first force on the image carrying drum to push the image carrying drum towards the follower roller. A pre-tensioned pushing spring 48 is provided between the follower roller and the intermediate support frame which exerts a predetermined second force on the follower roller to push the follower roller against the first flange 41 and the second flange 42. The pre-tensioning of the respective springs should be such that the first force is smaller than the second force. Preferably this first force is in the range between 20 and 80 percent of the second force. More preferably, the first force is between 30 and 50 percent of the second force. The second force is typically about 30 N.

In operation, in order to reproduce an image on a printing system, a sequence of printing signals is generated. Responsive to this sequence of printing signals the printing system sequentially forms the respective separation images of marking substance of the corresponding process color on the respective image forming members 7. In the respective pressure contact zones with the image transfer, the respective separation images are sequentially transferred to the image transfer member to thereby form a multi-color image thereon. To ensure that a registered multi-color image is formed on the image transfer member, the separation images need to be transferred to the image transfer member in register. The registration in the tangential direction is amongst others accomplished by accurately timing the respective separation image formation and transfer processes and by the direct mechanical coupling between the image forming members and the image transfer member using gearwheels 26 27. The registration in the axial direction between the respective separation images is accomplished by using the image registration device of FIG. 2 and FIG. 3 by providing for each image forming drum a follower roller which in operation is in rolling contact with both the flange on the associated image forming drum and the axially confined image transfer drum. Each follower roller is pressed towards the flange of the corresponding image forming drum and the flange of the image transfer drum with a second force exerted by spring 48 and being greater than the first force resulting from spring 47 and used for pressing the image forming drum towards the follower roller. The configuration is such that in balance, i.e., when the first force is equal to the force exerted by the follower roller on the flange of the image forming drum, the image forming drum and the image transfer drum are in a position resulting in perfect axial registration. When all of the image forming drums are in balance, a registered multi-color image is formed on the image transfer member. When one of the image forming drums is temporarily unbalance, e.g., caused by a person leaning on the printer, the pressure of the associated rotating follower roller on the flange of the image forming drum will quasi instantaneously change thereby enforcing the image forming drum to axially follow the image transfer drum. Hence such disruption will have no or only limited influence on the registration of the images.

The registered multi-color toner image on the image transfer member is heated by means known per se so that the marking substance, in casu dry particulate toner, softens and is rendered tacky. The printing system is such that the respective separation images of marking particles are formed complementary. This means that marking particles of a process color are accumulated on the free surface of the image-carrying member and substantially not on colored marking particles already accumulated on the image-carrying member. "Substantially not," means that any superimposed marking particles of different process colors will not lead to visual deficiencies, i.e., visual with the naked human eye, in the finally printed image.

The printing system subsequently transfers the registered multi-color toner image to a sheet of a recording medium which is controllably fed at the appropriate time by the conveyor rollers 21 through the transfer zone defined by establishing pressure contact between the rotating image transfer member and the rotating counter member. The sheet carrying the printed image is subsequently discharged by the cooperating conveyor belts 24 and 25. The image transfer member is further advanced towards the cleaning zone where any contaminants present on its surface may be removed by transferring them to the tacky surface of the rotating cleaning roller 30.

What is claimed is:

1. An image registration device for an image production system comprising a first rotatable element for carrying images of marking substance on its surface, said first rotatable element being provided with a first shaft and a first flange co-axially mounted on the first shaft adjacent the first rotatable element; and a second rotatable element for receiving on its surface images from the first rotatable element, the second rotatable element being mounted axially parallel with the first rotatable element such that, in operation, the second rotatable element is in rolling contact with the first rotatable element, the second rotatable element being provided with a second shaft and a second flange co-axially mounted on the second shaft adjacent the second rotatable element at the corresponding side compared to the mounting of the first flange, wherein the image registration device further comprises:

a third rotatable element and pressure exerting means for pressing in operation the third rotatable element with a predetermined pressure in rolling contact with the first flange and the second flange such that one of the first and second rotatable element axially follows the other one, whereby the pressure exciting means presses, in operation, the third rotatable element with a predetermined pressure in an axial direction of the first and second rotatable elements.

2. The image registration device as recited in claim 1, wherein only one of the first and second rotatable element is axially confined such that the other non-confined rotatable element axially follows the confined one.

3. The image registration device as recited in claim 2, wherein the image production system comprises a base support frame, and wherein the axially confined one of the first and second rotatable elements is rigidly connected to the base support frame.

4. An image registration device for an image production system comprising a first rotatable element for carrying images of marking substance on its surface, said first rotatable element being provided with a first shaft and a first flange co-axially mounted on the first shaft adjacent the first rotatable element; and a second rotatable element for receiving on its surface images from the first rotatable element, the second rotatable element being mounted axially parallel with the first rotatable element such that, in operation, the second rotatable element is in rolling contact with the first rotatable element, the second rotatable element being provided with a second shaft and a second flange co-axially mounted on the second shaft adjacent the second rotatable element at the corresponding side compared to the mounting of the first flange, wherein the image registration device further comprises:

a third rotatable element and pressure exerting means for pressing in operation the third rotatable element with a predetermined pressure in rolling contact with the first flange and the second flange such that one of the first and second rotatable element axially follows the other one;

wherein only one of the first and second rotatable element is axially confined such that the other non-confined rotatable element axially follows the confined one;

wherein the pressure exerting means is an elastic pressure exerting means.

5. The image registration device as recited in claim 4, wherein the elastic pressure exerting means comprises a first spring for pressing the third rotatable element towards the first and second flange and a second spring for pressing the non-confined one of the first and second rotatable elements towards the third rotatable element.

6. An image registration device for an image production system comprising a first rotatable element for carrying images of marking substance on its surface, said first rotatable element being provided with a first shaft and a first flange co-axially mounted on the first shaft adjacent the first rotatable element; and a second rotatable element for receiving on its surface images from the first rotatable element, the second rotatable element being mounted axially parallel with the first rotatable element such that, in operation, the second rotatable element is in rolling contact with the first rotatable element, the second rotatable element being provided with a second shaft and a second flange co-axially mounted on the second shaft adjacent the second rotatable element at the corresponding side compared to the mounting of the first flange, wherein the image registration device further comprises:

a third rotatable element and pressure exerting means for pressing in operation the third rotatable element with a predetermined pressure in rolling contact with the first flange and the second flange such that one of the first and second rotatable element axially follows the other one;

wherein the angle between the rotation axis of the third rotatable element and the first shaft is in the range of from 85 degrees to 95 degrees.

7. The image registration device as recited in claim 6, further comprising control means for controlling the angle between the rotation axis of the third rotatable element and the first shaft.

8. An image registration device for an image production system comprising a first rotatable element for carrying images of marking substance on its surface, said first rotatable element being provided with a first shaft and a first flange co-axially mounted on the first shaft adjacent the first rotatable element; and a second rotatable element for receiving on its surface images from the first rotatable element, the second rotatable element being mounted axially parallel with the first rotatable element such that, in operation, the second rotatable element is in rolling contact with the first rotatable element, the second rotatable element being provided with a second shaft and a second flange co-axially mounted on the second shaft adjacent the second rotatable element at the corresponding side compared to the mounting of the first flange, wherein the image registration device further comprises:

a third rotatable element and pressure exerting means for pressing in operation the third rotatable element with a predetermined pressure in rolling contact with the first flange and the second flange such that one of the first and second rotatable element axially follows the other one;

wherein only one of the first and second rotatable element is axially confined such that the other non-confined rotatable element axially follows the confined one;

wherein the axially confined one of the first and second rotatable elements is the second rotatable element.

9. The image registration device as recited in claim 8, wherein the first rotatable element is replaced by a plurality of first rotatable elements, each for carrying images of marking substance on its surface, each being provided with a first shaft and a first flange co-axially mounted on the first shaft adjacent the respective first rotatable element, the image registration device further including a plurality of third rotatable elements and a plurality of pressure exerting means, each of the plurality of pressure exerting means for pressing, in operation, each of the plurality of third rotatable elements with a predetermined pressure in rolling contact with the first flange and the second flange such that each of the plurality of first rotatable elements follows the axially confined second rotatable element.

10. The image registration device as recited in claim 9, wherein each of the angles between the rotation axis of each of the third rotatable elements and each first shaft of the corresponding first rotatable element is substantially the same.

* * * * *